United States Patent [19]

Leneave

[11] Patent Number: 4,876,867

[45] Date of Patent: Oct. 31, 1989

[54] DOOR LOCK

[76] Inventor: William H. Leneave, R.R. 1, Box 39, Dix, Ill. 62830

[21] Appl. No.: 234,026

[22] Filed: Aug. 18, 1988

[51] Int. Cl.[4] ..... E05B 17/14

[52] U.S. Cl. ..... 70/428; 70/209

[58] Field of Search ..... 70/428, 424, 426, 209, 70/210, 211, 212, 423

[56] References Cited

U.S. PATENT DOCUMENTS

| | | | |
|---|---|---|---|
| 3,623,346 | 11/1971 | Curtin | 70/424 |
| 3,636,742 | 1/1972 | Raney | 70/424 |
| 4,285,221 | 8/1981 | Atchisson | 70/428 |
| 4,561,273 | 12/1985 | Robinson | 70/424 |
| 4,570,470 | 2/1986 | Gray | 70/428 |

*Primary Examiner*—Robert L. Wolfe

*Attorney, Agent, or Firm*—Senniger, Powers, Leavitt and Roedel

[57] ABSTRACT

A door lock for placement on a door handle having a knob with a front face having a keyhole therein. The door lock comprises a tubular casing substantially closed at one end by an end wall member and open at its other end for enabling the casing to be placed on the handle in a position wherein the knob is disposed in the casing with its front face adjacent the end wall member. The tubular casing has an inside radial dimension sufficient to permit the casing to rotate freely on the knob. A locking lever is pivotably connected to the casing generally adjacent its open end to permit the lever to swing between a non-obstructing position wherein the casing may be placed on the door handle and removed from the door handle, and an obstructing position wherein the lever obstructs the open end of the casing and is engageable by the knob when the casing is on the handle for preventing the casing from being pulled off the handle. The locking lever may be locked in the obstructing position whereby, when the casing is on the door handle, the knob cannot be turned and the substantially closed end wall member prevents a key from being inserted into the keyhole. A second embodiment of the invention is also disclosed.

4 Claims, 2 Drawing Sheets

DOOR LOCK

BACKGROUND OF THE INVENTION

This invention relates generally to door locks and, more particularly, to an improved door lock for a door handle.

A common problem associated with the security of door locks contained within door handles, especially those in hotels or the like, is that they can be opened by a master key. Moreover, such a door lock can often be forced open by turning the door handle with sufficient force to break the lock. A related problem associated with such door locks, especially those in apartments or other premises which may be rented, is that persons other than the owner (e.g., tenants) may have keys to open the lock. Occasions may arise where the owner of the premises wishes to prevent persons who may have keys from entering the premises. In such situations, the owner is ordinarily required to replace all of the door locks which such persons may be able to open. Even if the owner goes to the effort and expense of replacing the door locks, the person who is denied access to the premises may attempt to force open the door lock by turning the door handle with sufficient force to break the lock. Devices heretofore made in an attempt to thwart these methods of opening such door locks are difficult to lock to a door handle, thus making their use, especially by the general public, impractical. There is, therefore, a need for a door lock for a door handle which is easy to use, and prevents insertion of a key into the keyhole and turning of the door handle.

Reference may be made to U.S. Pat. Nos. 3,952,564 and 4,570,470 disclosing devices generally in the field of this invention. It will be noted, however, that locking such devices to a door handle is difficult due to the complicated locking mechanisms and other features.

SUMMARY OF THE INVENTION

Among the several objects of this invention may be noted the provision of a device for preventing opening of a door lock contained within a door handle by preventing insertion of a key into the keyhole of the door handle; the provision of such a device which prevents opening of such a door lock by preventing turning of the door handle; and the provision of a device which is simple to use and economical to manufacture.

A door lock of the present invention is adapted for placement on a door handle having a knob with a front face having a keyhole therein. Generally, the door lock comprises a tubular casing substantially closed at one end by an end wall member and open at its other end for enabling the casing to be placed on the handle in a position wherein the knob is disposed in the casing with its front face adjacent the end wall member, the tubular casing having an inside radial dimension sufficient to permit the casing to rotate freely on the knob, a locking lever pivotably connected to the casing generally adjacent its open end to permit the lever to swing in a plane extending generally radially with respect to the casing between a non-obstructing position wherein the casing may be placed on the door handle and removed from the door handle, and an obstructing position wherein the lever obstructs the open end of the casing and is engageable by the knob when the casing is on the handle for preventing the casing from being pulled off the handle, and locking means for locking the lever in the obstructing position whereby, when the casing is on the door handle, the knob cannot be turned and the substantially closed end wall member prevents a key from being inserted into the keyhole.

Another aspect of this invention involves a door lock having two part-cylindric casing members each having a generally convex outer surface, a generally concave inner surface, a pair of arcuate end edges, and a pair of generally straight side edges, hinge means for connecting the casing members adjacent one of their side edges for swinging movement of the casing members between an open position wherein the casing members may be applied to a door knob and a closed position wherein the casing members form a tubular casing adapted to encase the knob, the casing having an inside dimension greater than the outside dimension of the knob so that the casing may freely rotate on the knob, an end wall member integrally joined to one casing member adjacent one arcuate and edge thereof for substantially closing one end of the tubular casing when the casing members are closed, lip means on at least one casing member adapted to project inwardly into the casing when the casing members are closed at a location spaced from the end wall member, and means for locking the casing members in the closed position with the knob received in the tubular casing between the end wall member and the lip means in a position wherein the end wall member prevents a key from being inserted in the keyhole and the lip means prevents the casing from being pulled off the handle.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
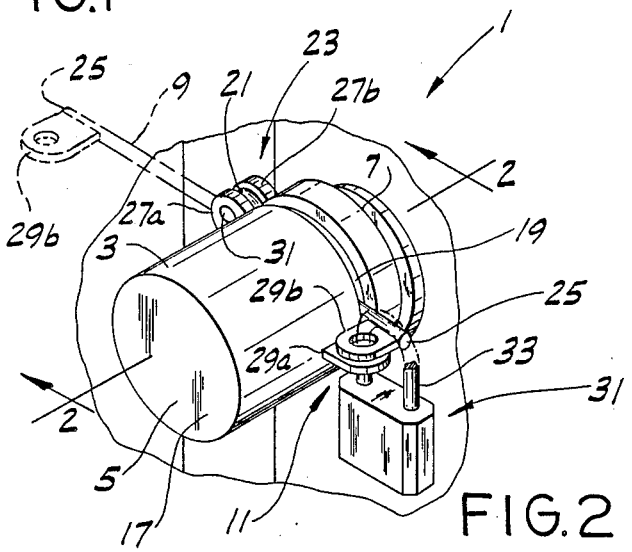
FIG. 1 is a perspective view of a door lock of the present invention in place on a door handle (not shown), the door lock being shown as having a casing and locking lever with the locking lever being shown in the non-obstructing position (in broken lines) and locked in the obstructing position (in solid lines)
Figure 2:
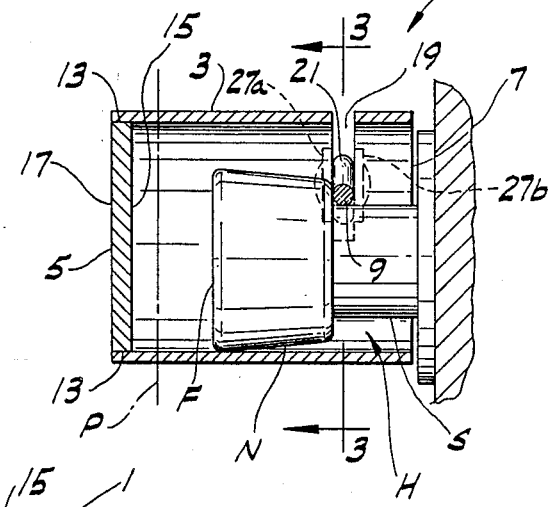
FIG. 2 is a sectional view taken along line 2—2 of FIG. 1 showing the door lock placed on a door handle with the locking lever in its obstructing position.
Figure 3:
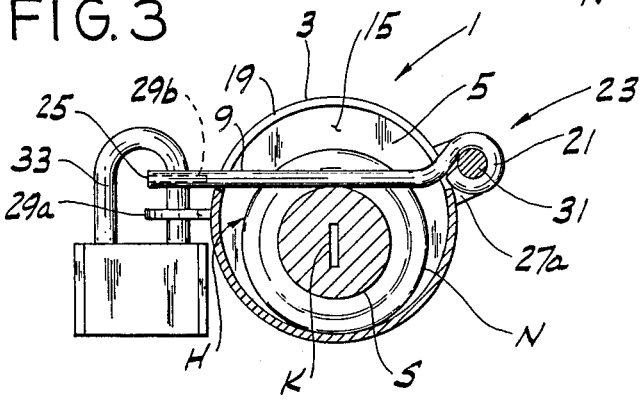
FIG. 3 is a view taken along line 3—3 of FIG. 2.

Referring now to FIGS. 1-3 of the drawings, a door lock of the present invention, designated in its entirety by the reference numeral 1, is shown in place on a door handle generally designated H having a knob N with a front face F, a shaft S, and a lock (not shown) disposed within the shaft and knob. The front face F of the handle has a keyhole K to allow insertion of a key into the handle H to operate the lock in the handle.

As illustrated, the door lock 1 comprises a tubular casing 3 substantially closed at one end by an end wall member 5 and open at the opposite end 7. The tubular casing 3 is placed on the handle H in a position wherein the knob N is disposed in the casing with its front face F adjacent the end wall member 5 thereby preventing a key from being inserted into the keyhole K. The inside radial dimension (diameter) of the tubular casing 3 is greater than the outer radial dimension (diameter) of the knob N to permit the casing to rotate freely on the knob thereby preventing the knob from being turned. The door lock 1 further comprises a locking lever 9 pivotally connected to the casing 3 to swing between a "non-obstructing position", shown in phantom in FIG. 1, wherein the casing may be placed on and removed from the door handle H, and an "obstructing position", shown in solid lines in FIG. 1, wherein the lever obstructs the open end 7 of the casing to prevent the casing from being pulled off the handle H. The door lock 1 includes locking means generally designated 11 to enable the lever 9 to be locked in its obstructing position.

More specifically, the tubular casing 3 is generally cylindrical with circular edges at opposite ends. As shown in FIG. 2, the axial dimension of the casing 3 is sufficient so that the casing may encase the entire knob N and a portion of the shaft S adjacent the knob. The casing 3 has a circumferential slot 19 generally adjacent its open end 7 so that, when the casing is placed on the handle H, the slot is adjacent the shaft S enabling the lever 9 to swing into the obstructing position, as will be described hereinafter. The casing 3 is preferably formed of metal or the like. Other materials are possible, although they must have sufficient strength to resist forcible removal of the casing 3 when locked to the handle H. It will be understood that the tubular casing 3 may have shapes other than cylindrical and still fall within the scope of the invention. A cylindrical casing 3 is preferred, however, since a casing having this shape requires the least amount of material to encase the knob N.

As shown in FIG. 3, the end wall member 5 comprises a circular plate having a diameter slightly less than the inner diameter of the casing 3. The end wall member 5 is disposed within the casing 3 in generally perpendicular relation thereto with the edge 13 of the member adjoining the inner surface of the casing and one side 15 of the member facing the interior of the casing. The other side 17 of the end wall member is flush with the adjacent end edge of the casing. The end wall member 5 is integrally attached to the casing 3, as by welding or the like, thereby preventing access to the keyhole K when the casing is placed on the door handle H. It will be understood that the end wall member 5 may only partially close the end of the casing and still fall within the scope of the invention provided that the member obstructs entry of a key into the keyhole K when the casing is placed on the door handle H. The material of the end wall member 5 is preferably the same as the casing 3, but may be different provided it has sufficient strength to enable the member to resist entry of a key into the keyhole K when the casing is placed on the handle H.

The locking lever 9 comprises an elongate member having one end 21, constituting its hinged end, pivotally connected to the casing 3 adjacent one end of the slot 19 by a lever hinge generally designated 23. The hinged end 21 of the lever 9 is formed in a loop for connection to the lever hinge 23. The other end 25 of the member constitutes the free end of the lever. The thickness of the lever 9 is less than the axial width of the slot 19 enabling the lever to be received therein and swung to the obstructing position. The length of the lever 9 is greater than the chordal dimension between the ends of the slot 19 so that, when the lever is in the obstructing position, the free end 25 projects outwardly beyond the casing as shown in FIGS. 1 and 3, thereby enabling the lever to be locked in such position, as will be described hereinafter.

As best shown in FIGS. 1 and 3, the lever hinge 23 comprises a pair of parallel spaced-apart hinge flanges *27a, 27b*, each having respective openings therein. The flanges *27a, 27b* project from the outer surface of the casing 3 adjacent opposite side edges of the slot 19 so that the plane of each flange is parallel to a plane P extending generally radially with respect to the casing. The openings in the flanges are in registry. The looped end 21 of the locking lever 9 is received between the hinge flanges *27a, 27b* so that the looped end and the openings *29a, 29b* in the hinge flanges are in registry. A pivot pin 31 is received in the openings in the flanges *27a, 27b* thereby enabling the lever 9 to swing between the obstructing position and non-obstructing position in a plane parallel to plane P.

The locking means 11 comprises a pair of corresponding locking flanges *29a, 29b* each having an opening therein, and a padlock generally designated 31 having a shackle 33. One flange *29a* projects from the outer surface of the casing 3 adjacent the end of the slot 19 opposite the lever hinge 23. The other flange *29b* is attached to the free end 25 of the lever 9 so that, when the lever is in the obstructing position, the openings in the locking flanges *29a, 29b* align with one another, thus allowing the shackle 33 of the padlock 31 to be received in the openings.

The door lock 1 is placed on a door handle H by swinging the free end 25 of the locking lever away from the casing 3 to its non-obstructing position and placing the casing on a door handle H so that the door knob N is received in the open end 7 of the casing. The casing 3 is positioned on the handle H with the end wall member 5 adjoining the front face F of the knob N. The locking lever 9 is then swung toward the casing 3 and received in the slot 19 so that it extends from one end of the slot to the other across the interior of the casing 3 in the region between the knob N and the open end 7 of the casing as best shown in FIGS. 2 and 3. The locking lever 9 thereby obstructs the open end 7 so that, if removal of the casing 3 is attempted, the knob N will engage the lever. The locking lever 9 enables the casing 3 to be locked to door handles having a variety of shapes and sizes so long as the radial dimension of the shaft S is sufficiently small to allow the lever to be placed in the obstructing position, and the radial dimension of the knob N exceeds that of the obstructed opening of the casing. The locking lever 9 may be locked in the obstructing position by inserting the shackle 33 of the padlock 31 through the openings in the locking flanges 33, 35 and locking the padlock.

Figure 4:
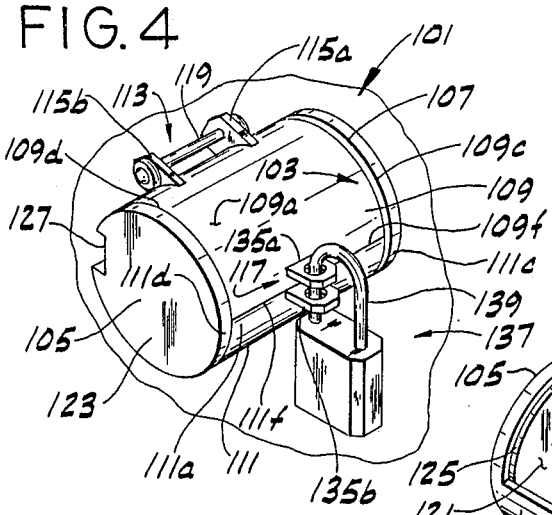
FIG. 4 is a perspective view of a second embodiment of a door lock of the present invention locked by a padlock in a closed position encasing a door knob (not shown)
Figure 7:
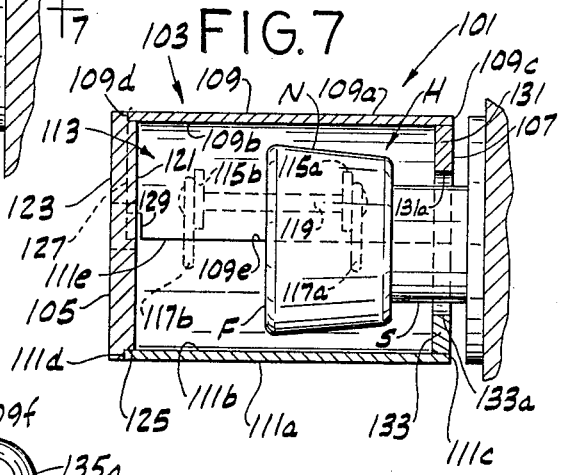
FIG. 7 is a sectional view taken along line 7—7 of FIG. 6.
Figure 8:
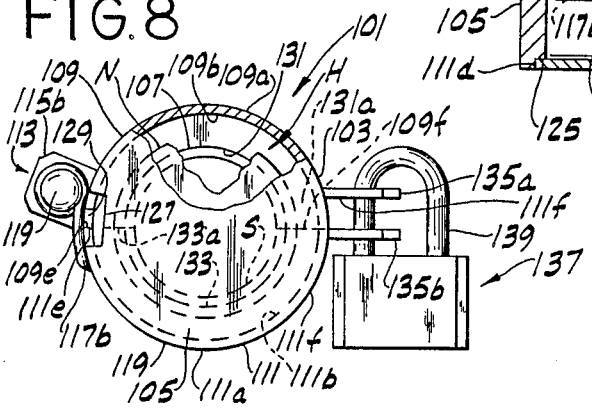
FIG. 8 is a left end elevation of the door lock of FIG. 4, portions of the door lock being broken away to show the door knob (in broken lines) within the door lock.

A second embodiment of the door lock, designated in its entirety by the reference numeral 101, is shown in FIGS. 4 and 7 in place on a door handle generally designated H having a knob N with a front face F, a shaft S, and a lock (not shown) disposed within the shaft and knob. The front face F of the handle H has a keyhole K to allow insertion of a key into the handle to operate the lock in the handle. The second embodiment 101 includes a tubular casing generally designated 103 substantially closed at one end by an end wall member 105 and open at the opposite end 107. The casing 103 comprises two part-cylindric casing members 109, 111 connected by hinge means generally designated 113 for swinging movement between an open position, shown in FIG. 5, wherein the casing members 109, 111 may be applied to the door handle H and a closed position, shown in FIG. 4, wherein the casing members form the tubular casing 103 enabling the members to encase the door handle. As shown in FIG. 7, the inside dimension of the tubular casing 103 is greater than the outside dimension of the knob N so that the casing may freely rotate on the knob thereby preventing the knob from being turned. The tubular casing 3 is placed on the handle H in a position wherein the knob N is disposed in the tubular casing 103 with its front face F adjacent the end wall member 105 thereby preventing a key from being inserted into the keyhole K. The second embodiment 101 further comprises lip means generally designated 115 adapted to project inwardly from the casing members 109, 111 adjacent the open end 107 of the casing 103 so that, with the knob N received in the tubular casing 103 between the end wall member 105 and the lip means, the lip means prevents the casing from being pulled off the hanndle H. The second embodiment 101 also includes locking means generally designated 117 for retaining the casing members 109, 111 in the closed position.

The casing member 109 has a generally convex outer surface **109*a*, a generally concave inner surface 109*b*, opposite arcuate end edges 109*c*, 109*d*, and parallel generally straight side edges 109*e*, 109*f*. The casing member 111 similarly has a generally convex outer surface 111*a*, a generally concave inner surface 111*b*, opposite arcuate end edges 111*c*, 111*d*, and opposite generally straight side edges 111*e*, 111*f*. The casing members 109, 111 have essentially identical dimensions so that the tubular casing 103 is formed by placing the side edges 109*e*, 111*f*, and 109*f*, 111*e* of the casing members in abutting relation with respect to one another. As shown in FIG. 7, the axial dimension of the casing members 109, 111 is sufficient so that the tubular casing 103 may encase the entire knob N and a portion of the shaft S adjacent the knob. The casing membes 109, 111 are preferably formed from metal or the like although other materials having sufficient strength are possible. It will be understood that the casing members 109, 111** may have other shapes and still fall within the scope of this invention. However, part-cylindric casing members are preferred since such casing members form a cylindrical tubular casing which requires the least amount of material to encase the handle H.

Figure 5:
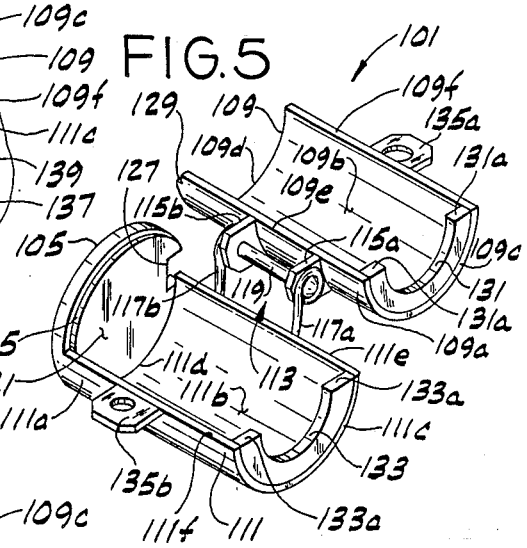
FIG. 5 is a perspective view of the door lock of FIG. 4 in an open position.
Figure 6:
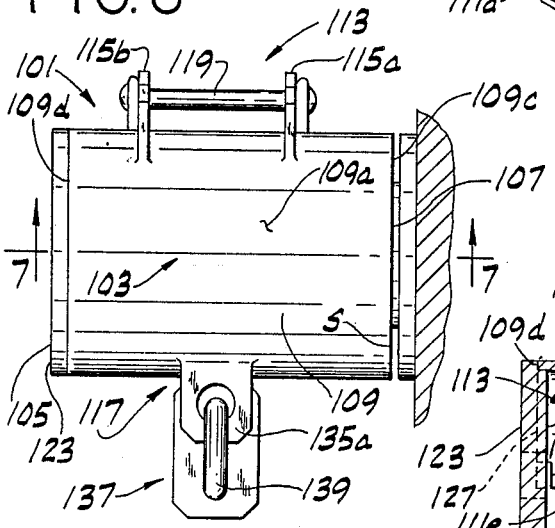
FIG. 6 is a top plan view of the door lock of FIG. 4.

The hinge means 113, best shown in FIGS. 4 and 5, comprises a pair of parallel spaced-apart hinge flanges **115*a*, 115*b* each having an opening therein. The flanges 115*a*, 115*b* project from the outer surface 109*a* of the casing member 109 adjacent side edge 109*e* generally equidistant from the respective arcuate end edges 109*c*, 109*d*. A pair of corresponding hinge arms 117*a*, 117*b* project in the direction of the hinge flanges 115*a*, 115*b* from the outer surface 111*a* of the casing member 111 adjacent the side edge 111*e*. A shaft 119 extends between the ends of the hinge arms 117*a*, 117*b* generally parallel to the side edges 109*e*, 111*e* with the shaft extending through the openings in the hinge flanges 115*a*, 115*b*. The casing members 109, 111** are thereby able to swing between the open and closed positions.

The end wall member 105 comprises a circular plate having an inner face 121 and an outer face 123, shown in FIGS. 4 and 5, and a diameter generally equal to the outer diameter of the casing 103. The periphery of the end wall member 105 is rabbetted adjacent the inner face 121 of the member with the depth of the recess 125 being approximately equal to the thickness of the casing members 109, 111. The arcuate end edge **111*d* of the casing member 111 is received in the recess 125 with the end wall member 105 disposed in generally perpendicular relation to the casing member 111 and the peripheral edge of the member 105 generally flush with the outer surface 111*a* of the casing member 111. The end wall member 105 is joined to the casing member 111 by welding or the like to be integral therewith. When the casing members 109, 111 are in the closed position, the arcuate end edge 109*d* of casing member 109 is received in the recess 125 and the outer surface 109*a* is generally flush with the peripheral edge of the end wall member 105. It will be understood that the end wall member 105 may only partially close the end of the casing and still fall within the scope of the invention provided that the end wall obstructs entry of a key into the keyhole K when the casing 103 is placed on the door handle H. The material of the end wall member 105 is preferably the same as the casing 103**.

As best shown in FIGS. 4 and 5, a generally rectangular notch 127 is formed in the peripheral edge of the end wall member 105 adjacent the side edges **109*e*, 111*e* of the casing members. The slot 127 provides clearance between the end wall member 105 and the arcuate end edge 109*d* to facilitate swinging of the casing member 109 to the closed position. To provide further clearance and facilitate swinging of the casing member 109 to the closed position, a notch 129 is formed in the corner of the casing member 109 between the arcuate end edge 109*d* and the side edge 109*e***.

Lip means 115 comprises a pair of arcuate lip flanges 131, 133 having end edges **131*a*, 133*a* respectively. The flanges 131, 133 are disposed adjacent the end edges 109*c*, 111*c* of the casing members, respectively, and in perpendicular relation with respect to the casing members 109, 111. The flanges 131, 133 may be joined to the respective casing members 109, 111 by welding or the like, or may be cast as part of the casing members. When the casing members 109, 111 are in the closed position, the lip flanges 131, 133 project radially inward from the respective end edges 109*c*, 111*c* of the casing, and the end edges 131*a*, 133*a* of each flange abut one another thereby forming an annular flange. It will be understood that the lip flanges 131, 133 may be joined to the concave sides 109*b*, 111*b* of the casing members between the end edges 109*c*, 111*c*, and 109*d*, 111*d*, respectively, and still fall within the scope of the invention. The lip flanges 131, 133 must, however, be spaced a sufficient distance from the end wall member 105 to enable the knob N to be disposed between the wall member and the lip flanges when the casing members 109, 111 are in the closed position. It will also be understood that the lip means 115 may comprise one or more sector shaped flanges which do not form a continuous annular flange when the casing members 109, 111 are in the closed position. Such flanges must, however, be sized to sufficiently obstruct the open end 107** of the casing so that removal of the casing from the handle H is prevented.

The locking means 117 shown in FIGS. 4 and 5 comprises a pair of corresponding locking flanges 135*a*, 135*b* each having an opening therein, and a padlock generally designated 137 having a shackle 139. One locking flange 135*a* projects from the outer surface 109*a* of the casing member 109 adjacent the side edge 109*f* generally midway between the end edges 109*c*, 109*d*. The other locking flange 135*b* similarly projects from the outer surface 111*a* adjacent the side edge 111*f* generally midway between the end edges 111*c*, 111*d*. The planes of the locking flanges 135*a*, 135*b* are both generally parallel to the respective side edges 109*f*, 111*f*. When the casing members 109, 111 are swung to the closed position, the openings in the locking flanges align with one another allowing the shackle 139 of the padlock 137 to pass through the openings.

The door lock 101 is placed on the door handle H by swinging the casing members 109, 111 apart to the open position and applying the members to the door handle H with the knob N disposed inside the members and the end wall member 105 adjacent the front face F of the knob. The members 109, 111 are then swung to the closed position wherein the members form a tubular casing 103 which encases the knob N with the knob disposed between the end wall member 105 and the lip means 115. Removal of the casing 103 from the handle H is prevented since the knob N will engage the lip flanges 131, 133 if removal of the casing from the handle is attempted. The casing members 109, 111 may be locked in the closed position by inserting the shackle 139 of the padlock 137 through the openings in the locking flanges 135*a*, 135*b* and locking the padlock.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A door lock adapted for placement on a door handle having a knob with a front face having a keyhole therein, said door lock comprising a tubular casing substantially closed at one end by an end wall member and open at its other end for enabling the casing to be placed on the handle in a position wherein the knob is disposed in the casing with its front face adjacent said end wall member, said tubular casing having an inside radial dimension sufficient to permit the casing to rotate freely on the knob, no more than one circumferential slot generally adjacent the open end, a locking lever pivotably connected to the casing adjacent one end of the slot to permit the lever to swing in a plane extending generally radially with respect to the casing between a non-obstructing position wherein the casing may be placed on the door handle and removed from the door handle, and an obstructing position wherein the lever is received in the slot and extends across the interior of the casing obstructing the open end of the casing, the lever being engageable by the knob when the casing is on the handle and the lever is in said obstructing position for preventing the casing from being pulled off the handle, and locking means for locking the lever in said obstructing position whereby, when the casing is on the door handle, the knob cannot be turned and said substantially closed end wall member prevents a key from being inserted into the keyhole.

2. A door lock as set forth in claim 1 wherein said locking means comprises a pair of corresponding locking flanges each having an opening therein, one flange being attached to the free end of the lever and the other flange being attached to the outer surface of the casing generally adjacent the other end of the slot whereby, when the lever is swung into the slot, the openings in the locking flanges align with one another allowing the shackle of a padlock to be inserted through the openings.

3. A door lock as set forth in claim 2 in combination with a padlock, said padlock having a shackle receivable in the openings in the locking flanges.

4. A door lock as set forth in claim 1 wherein said tubular casing is cylindric.

* * * * *